US009062495B2

(12) United States Patent
Johansson

(10) Patent No.: US 9,062,495 B2
(45) Date of Patent: Jun. 23, 2015

(54) DRILLING MACHINE

(75) Inventor: Anders Johansson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 436 days.

(21) Appl. No.: 13/261,477

(22) PCT Filed: Apr. 14, 2011

(86) PCT No.: PCT/SE2011/050462

§ 371 (c)(1),
(2), (4) Date: Oct. 17, 2012

(87) PCT Pub. No.: WO2011/139208

PCT Pub. Date: Nov. 10, 2011

(65) Prior Publication Data

US 2013/0037293 A1 Feb. 14, 2013

(30) Foreign Application Priority Data

May 3, 2010 (SE) ..... 1050438

(51) Int. Cl.

| | |
|---|---|
| ***B25D 17/24*** | (2006.01) |
| ***E21B 6/00*** | (2006.01) |
| ***B25D 9/26*** | (2006.01) |

(52) U.S. Cl.

CPC ... *E21B 6/00* (2013.01); *B25D 9/26* (2013.01); *B25D 2250/125* (2013.01); *B25D 2250/131* (2013.01)

(58) Field of Classification Search

CPC ..... B25D 9/26; B25D 2250/131; B25D 2250/125; B25D 2250/021; E21B 6/00

See application file for complete search history.

(56) References Cited

U.S. PATENT DOCUMENTS

| | | | | |
|---|---|---|---|---|
| 4,934,465 | A | 6/1990 | Salmi et al. | |
| 5,117,921 | A | 6/1992 | Bartels et al. | |
| 5,351,763 | A | 10/1994 | Muuttonen | |
| 5,896,937 | A | 4/1999 | Kaneko | |
| 6,318,478 | B1 | 11/2001 | Kaneko | |
| 6,367,565 | B1 * | 4/2002 | Hall | 175/50 |
| 7,234,548 | B2 | 6/2007 | Comarmond | |

FOREIGN PATENT DOCUMENTS

| | | | |
|---|---|---|---|
| EP | 0389454 | A1 | 9/1990 |
| SE | 458672 | | 4/1989 |
| WO | WO2007/073275 | A1 | 6/2007 |
| WO | WO2008/127172 | A1 | 10/2008 |

* cited by examiner

*Primary Examiner* — Andrew M Tecco
(74) *Attorney, Agent, or Firm* — Mark P. Stone

(57) ABSTRACT

The present invention relates to a drill comprising a shank adapter (3), a damping piston (5) with a forward end surface (18), a stop end surface (14) for the damping piston (5), a rotation chuck bushing (4) with a forward end surface (16), a stop end surface (17) for the rotation chuck bushing, a impact piston (2) with a brake land (10) with a forward end surface (19), and a brake chamber (8) for braking of the impact speed of the impact piston (2) during idle impacts, which brake chamber (8) has a rear edge (21). According to the invention, the actual idle impact stroke length (L1, L2) of the damping piston is greater than the idle impact braking distance (L3) of the impact piston, where the actual idle impact stroke length (L1, L2) of the damping piston is the shorter of the idle impact stroke length (L1) of the damping piston and the idle impact stroke length (L2) of the rotation chuck bushing.

20 Claims, 2 Drawing Sheets

DRILLING MACHINE

TECHNICAL AREA

The present invention relates to a drilling machine according to the preamble of claim 1.

THE PRIOR ART

A percussive rock drilling machine comprises a casing in which a impact piston moves forwards and backwards and impacts upon a shank adapter. Furthermore, a feed force is transferred to the shank adapter from a feed, as is also rotation from a rotation motor, through a driver. Impact energy, feed force and rotation are subsequently transferred from the shank adapter through one or several drill rods and a drill bit to the rock, such that a borehole is created.

One or several damping pistons are placed in contact with a rotation chuck bushing, which in turn is in contact at certain periods with the shank adapter. The principal function of the damping piston is to absorb reflected shock waves and convert these to heat. Furthermore, the damping piston helps to place the shank adapter in the correct position, ready for the next impact. The shank adapter is pressed into the drilling machine during drilling with the aid of the feed of the drilling machine. Inside the drilling machine, the shank adapter meets the damping piston through the rotation chuck bushing, whereby the damping piston balances the force from the feed.

A stop ring serves as an end stop for forward axial motion of the shank adapter. In the absence of a feed force that presses the shank adapter into the drilling machine, the shank adapter can travel forwards until it meets the stop ring. This may take place if, for example, the drill bit encounters a cavity in the rock, or if the threads between the drill rods need to be hammered free. In cases in which the drill bit is no longer in contact with the rock, the shank adapter can move freely between the stop ring and the rotation chuck bushing. If the impact piston impacts in this position, the shank adapter will bounce in an uncontrolled manner between the stop ring and the rotation chuck bushing. This may lead to parts at the front of the drilling machine becoming damaged.

DESCRIPTION OF THE INVENTION

The aim of the present invention is to solve the problems of the prior art technology through a drilling machine with a normal impact position, in which the components of the drilling machine are in a position for impact against rock, and with an idle impact position, in which the idle impact is an impact against air. The drilling machine comprises the following components: a shank adapter, a damping piston with a forward end surface, a stop end surface for the damping piston, a rotation chuck bushing with a forward end surface, a stop end surface for the rotation chuck bushing, an impact piston with a brake land with a forward end surface, and a brake chamber for braking of the impact speed of the impact piston during idle impacts, which brake chamber has a rear edge.

According to the invention, the damping piston has an idle impact stroke length defined as a distance between the stop end surface of the damping piston and the position of the forward end surface of the damping piston at the normal impact position of the drilling machine. The rotation chuck bushing has an idle impact stroke length that is defined as a distance between the stop end surface of the rotation chuck bushing and the position of the forward end surface of the rotation chuck bushing at the normal impact position of the drilling machine. The actual idle impact stroke length of the damping piston is the shorter of the idle impact stroke length of the damping piston and the idle impact stroke length of the rotation chuck bushing. The impact piston has an idle impact stroke length defined as a distance between the rear edge of the brake chamber and the position of the forward end surface of the brake land at the normal impact position of the drilling machine.

The actual idle impact stroke length of the damping piston is greater than the idle impact braking distance of the impact piston. The advantage of this is that the shank adapter cannot bounce back through any considerable distance in the event of idle impacts. The impact piston has sufficient time to brake before the idle impact occurs, and this reduces in a simple and effective manner the risk of damage to the drilling machine, and extends the lifetime of the drilling machine. It is appropriate that the impact speed of the impact piston be braked to 40-60%, preferably 50%, of the impact speed before idle impact occurs. It is preferable that the idle impact stroke length of the damping piston be shorter than the idle impact stroke length of the rotation chuck bushing.

DESCRIPTION OF DRAWINGS

The invention will be described in more detail with the aid of a preferred embodiment and with reference to the attached drawings, of which.

PREFERRED EMBODIMENT

Figure 1:
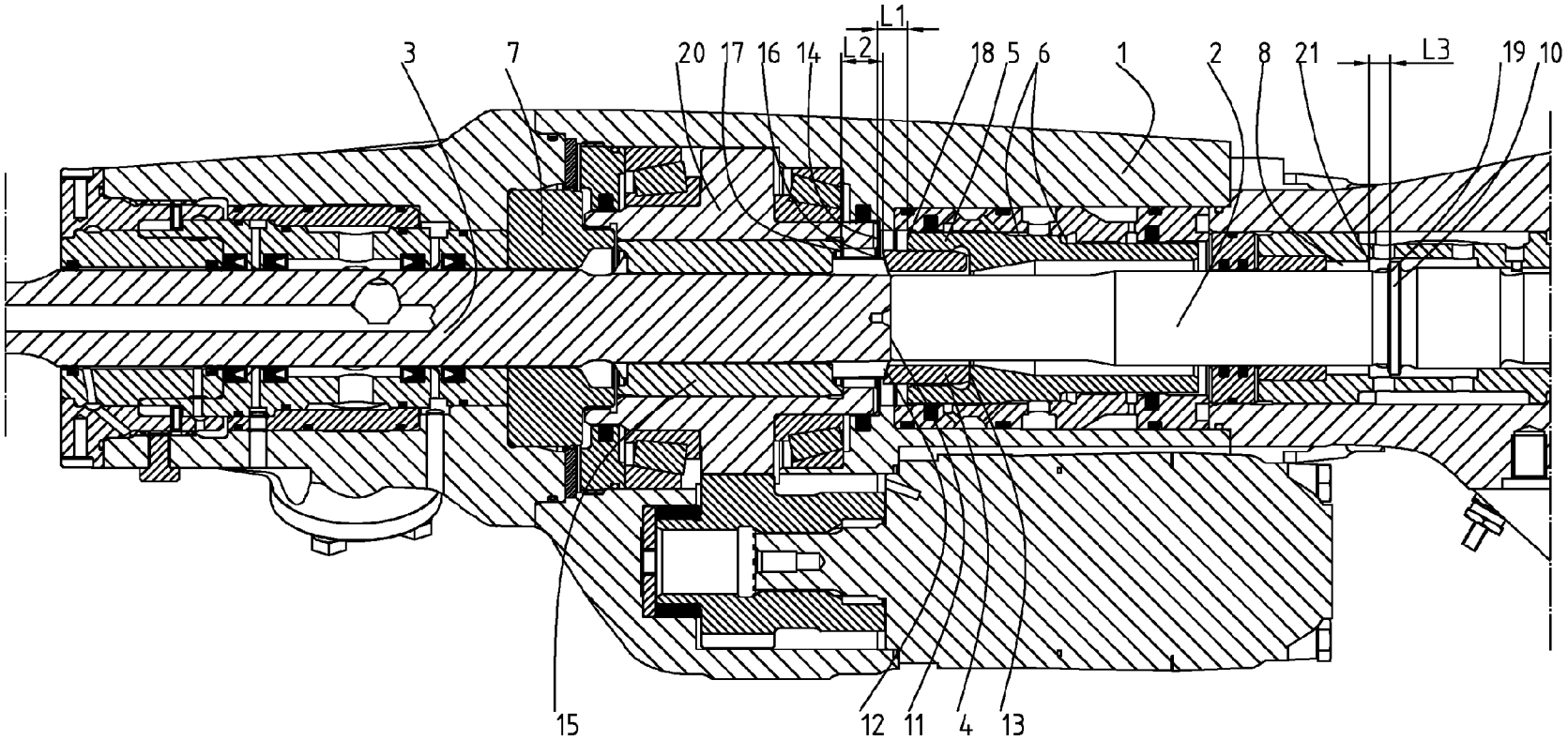
FIG. 1 shows a first embodiment in cross section
Figure 2:
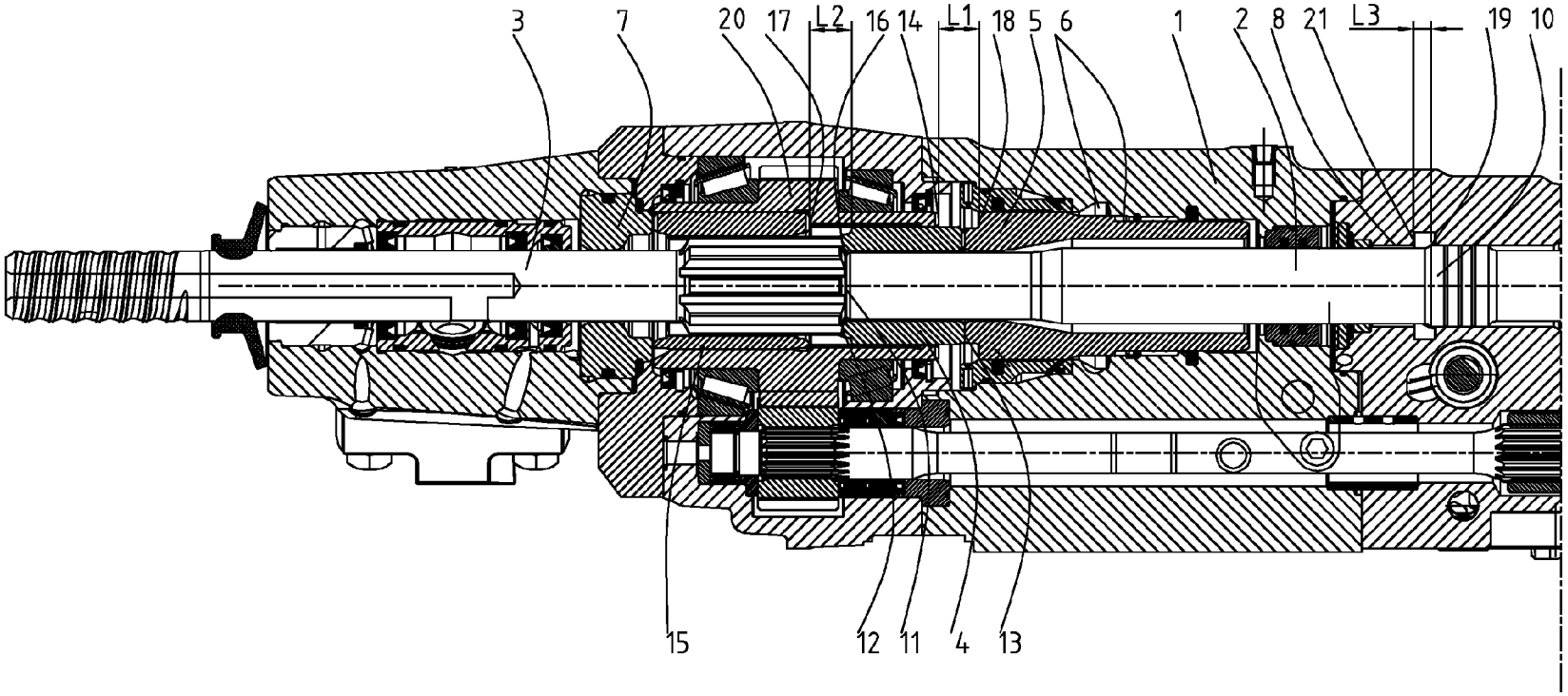
FIG. 2 shows a second embodiment in cross section.

FIGS. 1 and 2 show different embodiments of a drilling machine for drilling in rock, which drilling machine comprises a number of components. The drawings have been truncated somewhat such that the details do not become too small. The forward end of the drilling machine is defined as the end that is used against the rock, and the rear end of the drilling machine is defined as the end that is used facing away from the rock. The drilling machine comprises a casing 1 in which an impact piston 2 is displaceable in a reciprocating motion. The impact piston 2 acts through impacts onto a rear end surface 11 of a shank adapter 3, to which shank adapter 3 are connected drill rods, not shown in the drawings, and a drill bit, also this not shown in the drawings. Rotation is transferred to the shank adapter 3 through a rotation chuck 20 and a driver 15. The drilling machine is influenced also by a forwards feed force. The shank adapter 3 transfers impact energy, the feed force and the rotation to the rock through drill rods and drill bit.

At a surface radially outside of the impact-reception rear end surface 11 of the adapter, the shank adapter 3 has a contact area 12 for a forward end surface 16 of a rotation chuck bushing 4. Also the rotation chuck bushing 4 has a rear end surface 13, which in turn is influenced by a damping piston 5. In the example in FIG. 1, the damping piston 5 surrounds the rotation chuck bushing 4, but the damping piston 5 may also influence solely the rear end surface 13 of the rotation chuck bushing 4, as shown in FIG. 2. There are also various further variants of double damping pistons that may be used. The damping piston 5 and the rotation chuck bushing 4 principally move as a single unit and can thus be replaced by a single unit. There are, however, economic advantages and advantages of durability in having these as separate units. The damping piston 5 is in turn influenced by hydraulic fluid on one or several driving areas in one or several damping chambers 6.

During normal drilling, the damping piston 5 has the following function (several variants of which are possible): The drilling machine is influenced by a forwards feed force towards rock. There is, in the first stage, contact between the drill bit and the rock, while the impact piston 2 moves forwards. The damping piston 5, in combination with the rotation chuck bushing 4, helps to balance against the feed force, such that the shank adapter 3 is held in the correct position, ready for impact. In a second stage, the impact piston 2 continues forwards and impacts onto the shank adapter 3. This is the stage that is shown in FIG. 1 and FIG. 2. The components of the drilling machine then are in their normal impact positions. The impact causes the drill string and the drill bit to move forwards into the rock. Contact between the shank adapter 3 and the rotation chuck bushing 4 is at the same time lost.

In a third stage, the impact piston 2 reverses its direction and moves backwards. A constant flow of oil onto the driving area of the damping piston 5 in the damping chamber 6 forces the damping piston 5 forwards against the rotation chuck bushing 4, which regains contact with the shank adapter 3. In a fourth stage, the feed force compels the drilling machine ever forwards, but reflections from the rock cause the shank adapter 3, the rotation chuck bushing 4 and the damping piston 5 to move backwards. When the damping piston 5 moves backwards in the damping chamber 6, the oil in the damping chamber 6 is compressed, whereby the movement is braked and converted to heat.

This damping function works well, as long as the drill bit is in contact with the rock.

A stop ring 7 is arranged to protect the shank adapter 3. If the drill bit impacts air instead of rock—known as an idle impact or back hammering—because, for example, the drill bit encounters a cavity in the rock or because it is necessary to hammer free the threads between the drill rods, the stop ring 7 partially prevents the shank adapter 3 from moving forwards too much in the axial direction, and this reduces the risk of damage.

What happens during an idle impact is that the impact piston 2 impacts upon the shank adapter 3 such that the shank adapter 3 moves forwards without being stopped by rock, and the shank adapter 3 is stopped instead by the stop ring 7. The subsequent event then is determined at random. There is, thus, no normal well-defined idle impact position. Either the shank adapter 3 remains forward at the stop ring 7 or the shank adapter 3 rebounds backwards a certain distance, that may be short or long.

If the impact piston 2 impacts again onto the shank adapter 3 with undiminished force, it is possible that damage may arise in the forward part of the drilling machine. In the case that the shank adapter 3 remains at a forward position at the stop ring 7, the impact piston 2 can be braked before impact. This takes place with the aid of a brake chamber 8 with a rear edge 21. The brake chamber 8 in FIG. 2 is very narrow.

The impact piston 2 has a brake land 10 with a forward end surface 19. In the case of normal impacts against rock, it is appropriate that the normal position be such that the impact piston 2 does not travel sufficiently far forwards for the forward end surface 19 of the brake land to pass the rear edge 21 of the brake chamber, and thus no braking takes place. It is not desirable that braking take place during normal impacts against rock.

In the event of idle impacts, however, if the shank adapter 3 is located forwards at the stop ring 7, the impact piston 2 must travel a longer distance before the impact takes place. This means that the forward end surface 19 of the brake land passes the rear edge 21 of the brake chamber. When the forward end surface 19 of the brake land has passed the rear edge 21 of the brake chamber, the oil in the brake chamber 8 is compressed, and this brakes the impact piston 2, such that the impact speed is reduced before the impact occurs. The idle impact stroke length L2 is defined as the distance L2 between the rear edge 21 of the brake chamber and the position of the forward end surface 19 of the brake land at the normal impact position, i.e. the distance L2 that the forward end surface 19 of the brake land can travel from the normal impact position to the rear edge 21 of the brake chamber.

This functions best, in itself, if the shank adapter 3 should happen to be located forwards at the stop ring 7, but if the shank adapter 3 has bounced back through too great a distance, the impact piston 2 impacts the shank adapter 3 with full force.

The present invention prevents, however, the impact piston 2 from being able to impact onto the shank adapter 3 with full force in the event of idle impacts, by preventing the shank adapter 3 from being able to bounce back through too great a distance.

The idle impact stroke length L1 of the damping piston is defined as a distance L1 between a stop end surface 14 for the damping piston and the position of the forward end surface 16 of the damping piston at the normal impact position of the drilling machine, i.e. the maximum distance L1 that the damping piston 5 can move forwards from the normal impact position to the stop end surface 14 of the damping piston. It is appropriate that the stop end surface 14 of the damping piston be arranged at the rear edge of the rotation chuck 20, as shown in FIGS. 1 and 2, or at the casing 1.

It is also possible to stop the movement of the damping piston 5 through the rotation chuck bushing 4, with the forward end surface 16 of the rotation chuck bushing against the rear end surface 17 of the driver or through another stop end surface 17 for the rotation chuck bushing 4. This, however, is a poorer solution, since the driver 15 normally withstands wear less well than the rotation chuck 20 or the casing 1. The idle impact stroke length L2 of the rotation chuck bushing is defined as a distance L2 between the stop end surface 17 of the rotation chuck bushing and the position of the forward end surface 16 of the rotation chuck bushing at the normal impact position of the drilling machine, i.e. the maximum distance L2 that the rotation chuck bushing 4 (and thus consequently the damping piston 5) can move forwards from the normal impact position to the stop end surface 17 of the rotation chuck bushing. Other designs with a similar function can also be conceived.

Note that the expression "end surface" is not to be interpreted in so restricted manner that it defines only an end surface that has a plane surface perpendicular to the axis of the drilling machine. The end surfaces can have different appearances on different components, as can be seen in FIG. 1 and FIG. 2. The distance that is denoted is the shortest distance, i.e. the distance that the component 4, 5 would be able to move before it is compelled to stop.

The actual idle impact stroke length L1, L2 of the damper is defined as the shorter of the idle impact stroke length L1 of the damping piston and the idle impact stroke length L2 of the rotation chuck bushing. Thus it is in practice the actual idle impact stroke length L1, L2 of the damper that limits the distance that the damping piston 5 can move in the event of an idle impact.

As the above has made clear, the damping piston 5 and the rotation chuck bushing 4 hold the shank adapter 3 in the correct position before and during impacts. In the event of an idle impact, when there is no rock to prevent it, the damping piston 5 moves forwards until the damping piston 5 is stopped by the stop end surface 14 of the damping piston, or until the damping piston 5 is stopped by the rotation chuck bushing 4 which, in turn, is stopped by the stop end surface 17 of the rotation chuck bushing. The actual idle impact stroke length L1, L2 of the damping piston is, according to the invention, greater than the idle impact braking length L3. This ensures that the shank adapter 3 cannot bounce back through an indeterminate distance, in the event of an idle impact. To be more precise, it ensures that the forward end surface 19 of the brake land has sufficient time to pass the rear edge 21 of the brake chamber before the impact occurs, i.e. the impact piston 2 always has sufficient time to brake before the impact occurs, independently of where the shank adapter 3 happens to be located.

It is not necessarily the case that a greater degree of braking is an advantage. This may be a matter of judgement, depending on the circumstances. It may occasionally take place that the drilling machine becomes stuck, and in this case it is desirable to be able to impact the shank adapter while at the same time drawing the drilling machine backwards, free.

It may, therefore, be appropriate to be able to brake the impact piston such that the impact speed of the impact piston is reduced by approximately 40-60%, preferably 50%, before an idle impact takes place, i.e. a braking from 8 m/s to 4 m/s. All braking, however, has, obviously, a certain protective effect.

As an example, the idle impact braking length L3 may be approximately 10 mm, while the actual idle impact stroke length of the damping piston L1, L2 is approximately 15 mm.

The invention is, naturally, not limited to the example described above: it can be modified within the scope of the attached patent claims,

The invention claimed is:

1. A drilling machine with a normal impact position, in which the components of the drilling machine are in a position for impact against rock, and with an idle impact position, in which idle impacts are impacts against air, which drilling machine comprises the following components: a shank adapter; a damping piston with a forward end surface; a stop end surface for the damping piston; a rotation chuck bushing with a forward end surface; a stop end surface for the rotation chuck bushing; an impact piston with a brake land with a forward end surface; and a brake chamber for braking the impact speed of the impact piston in the event of idle impacts, which brake chamber has a rear edge; wherein the damping piston has an idle impact stroke length defined as a distance between the stop end surface of the damping piston and a position of the front end surface of the damping piston at the normal impact position of the drilling machine; the rotation chuck bushing has an idle impact stroke length defined as a distance between the stop end surface of the rotation chuck bushing and a position of the forward end surface of the rotation chuck bushing at the normal impact position of the drilling machine; the actual idle impact stroke length of the damping piston is the shorter of the idle impact stroke length of the damping piston and the idle impact stroke length of the rotation chuck bushing; the impact piston has an idle impact braking length defined as a distance between the rear edge of the brake chamber and a position of the forward end surface of the brake land at the normal impact position of the drilling machine; and the actual idle impact stroke length of the damping piston is greater than the idle impact braking length of the impact piston.

2. The drilling machine according to claim 1, wherein the drilling machine comprises a rotation chuck with a rear edge, which rear edge is arranged as the stop surface of the damping piston.

3. The drilling machine according to claim 2, wherein the drilling machine comprises a driver, the rear end surface of which is used as stop end surface of the rotation chuck bushing.

4. The drilling machine according to claim 3, wherein the idle impact stroke length of the damping piston is shorter than the idle impact stroke of the rotation chuck bushing.

5. A drill rig, wherein the drilling rig comprises a drilling machine according to claim 3.

6. The drilling machine according to claim 2, wherein the idle impact stroke length of the damping piston is shorter than the idle impact stroke of the rotation chuck bushing.

7. A drill rig, wherein the drilling rig comprises a drilling machine according to claim 6.

8. A drill rig, wherein the drilling rig comprises a drilling machine according to claim 2.

9. The drilling machine according to claim 1, wherein the drilling machine comprises a casing in which the stop end surface of the damping piston is arranged.

10. The drilling machine according to claim 9, wherein the drilling machine comprises a driver, the rear end surface of which is used as stop end surface of the rotation chuck bushing.

11. The drilling machine according to claim 10, wherein the idle impact stroke length of the damping piston is shorter than the idle impact stroke of the rotation chuck bushing.

12. A drill rig, wherein the drilling rig comprises a drilling machine according to claim 10.

13. The drilling machine according to claim 9, wherein the idle impact stroke length of the damping piston is shorter than the idle impact stroke of the rotation chuck bushing.

14. A drill rig, wherein the drilling rig comprises a drilling machine according to claim 9.

15. The drilling machine according to claim 1, wherein the drilling machine comprises a driver, the rear end surface of which is used as stop end surface of the rotation chuck bushing.

16. The drilling machine according to claim 15, wherein the idle impact stroke length of the damping piston is shorter than the idle impact stroke of the rotation chuck bushing.

17. A drill rig, wherein the drilling rig comprises a drilling machine according to claim 15.

18. The drilling machine according to claim 1, wherein the idle impact stroke length of the damping piston is shorter than the idle impact stroke of the rotation chuck bushing.

19. A drill rig, wherein the drilling rig comprises a drilling machine according to claim 18.

20. A drill rig, wherein the drilling rig comprises a drilling machine according to claim 1.

* * * * *